US008316672B2

(12) United States Patent
Karatzis

(10) Patent No.: US 8,316,672 B2
(45) Date of Patent: Nov. 27, 2012

(54) NET AND PROCESS FOR PRODUCING THE NET

(75) Inventor: Antonios M. Karatzis, Crete (GR)

(73) Assignee: Karatzis S.A., Crete (GR)

( * ) Notice: Subject to any disclaimer, the term of this patent is extended or adjusted under 35 U.S.C. 154(b) by 588 days.

(21) Appl. No.: 12/308,135

(22) PCT Filed: Jun. 6, 2006

(86) PCT No.: PCT/EP2006/005372
§ 371 (c)(1),
(2), (4) Date: Feb. 19, 2010

(87) PCT Pub. No.: WO2007/140801
PCT Pub. Date: Dec. 13, 2007

(65) Prior Publication Data

US 2010/0139327 A1 Jun. 10, 2010

(51) Int. Cl.
*D04B 1/22* (2006.01)

(52) U.S. Cl. ..... 66/170; 66/202

(58) Field of Classification Search ..... 66/169 R, 66/170, 192, 193, 195, 202
See application file for complete search history.

(56) References Cited

U.S. PATENT DOCUMENTS

| | | | | |
|---|---|---|---|---|
| 4,781,291 | A * | 11/1988 | VanGinhoven | 206/83.5 |
| 5,104,714 | A * | 4/1992 | Leiber et al. | 428/131 |
| 6,521,551 | B1 * | 2/2003 | Mass et al. | 442/1 |
| 8,079,236 | B2 * | 12/2011 | Willner et al. | 66/151 |
| 2007/0210018 | A1 * | 9/2007 | Wallwiener et al. | 211/13.1 |

FOREIGN PATENT DOCUMENTS

| | | |
|---|---|---|
| EP | 0 891 698 | 1/1999 |
| WO | WO 96/10107 | 4/1996 |
| WO | 99/28541 | 6/1999 |
| WO | WO 2004/020721 | 3/2004 |

* cited by examiner

*Primary Examiner* — Danny Worrell
(74) *Attorney, Agent, or Firm* — D. Peter Hochberg; Sean F. Mellino; Daniel J. Smola

(57) ABSTRACT

A net is made from a multi-layer film which is used to produce at least two layers of synthetic yarns that are unified by application of a thermal process.

23 Claims, 6 Drawing Sheets

State of the Art

State of the Art

NET AND PROCESS FOR PRODUCING THE NET

This application is a National Stage application of International Application No. PCT/EP2006/005372, filed on Jun. 6, 2006.

BACKGROUND OF THE INVENTION

1. Field of the Invention

This present invention refers to a net made from a multi-layer film, the net being made from knitted yarn which has been thermally treated and compressed.

Further the invention pertains to manufacturing and production method pertaining to knitted products made from synthetic yarns having controlled properties.

2. Description of the Prior Art

As already known, in order to manufacture various nets, prestretched or non-prestretched synthetic yarns are widely used, which, depending on the pattern and knitting schema, yield a variety of different products. Such products are pipe-shaped nets used for fruit packaging, straw nets used for pallet wrapping-shading, nets used for protection against hail-storms, insects, sunlight, low temperatures, etc. (FIGS. 1 and 2). Such nets are manufactured by a knitting machine that may be a Raschel knitting machine.

All such products have certain features in common. The fibers which they are knitted from are made of homogenous materials or of a combination of various mixed materials. When mixing different materials, a sufficient level of control over the properties of the manufactured product could not be achieved. As for the effective use of such materials, their mechanical properties—like elasticity, tensile strength and hardness—are quite important. Equally pursued is the reaction of single-layer yarns with regard to permeability, strength and also solar radiation filtering.

Another common characteristic of such net products is that, if they are severed or torn and not properly repaired or processed at the damaged area, the said nets tend to lose their strength and not only are they destroyed, but are also torn to pieces, and their remainders are scattered about or cause entanglements.

In addition, a number of single-layer knitted products, such as pallet wrapping straw, have a certain drawback as they tend to produce fine threads when cut. These fine threads create serious problems, since they block rolling conveyors, interfere with photocells, etc.

SUMMARY OF THE INVENTION

It is the object of the present invention to avoid the drawbacks of the state of the art and to provide a net with improved properties.

This object is resolved by a net made of a net material which comprises at least two layers of synthetic yarns that are homogenized by application of a thermal process and a compression process.

The innovation of the recommended method thus solves a number of the problems of the state of the art and thus allows the manufacturing of products that can be used in an enhanced way.

Advantageous embodiments of the invention are claimed by the dependent claims and are disclosed in more detail by the description.

Particularly, the net is homogenized by thermal treatment and compression. In a preferred embodiment, the net is prestretched.

Preferably, the yarns are derived from co-extrusion of the thermoplastic material to form a film which is cut into strips to make yarn, the yarn being knitted.

In a preferred embodiment the film comprises multiple layers, advantageously at least three layers.

Preferably, the net comprises at least a single layer that comprises at least a single synthetic yarn that is made of an polyolefine or a combination of polyolefines, particularly of high-density or low-density polyethylene, especially of PE, EVA, PVC, PA or of a mixture of polyolefines.

In a preferred embodiment the at least one of the layers comprises at least a single iridescent or polycarbonic material rendering the net iridescent.

According to the invention it is preferably foreseen that the iridescent or polycarbonic material is chosen so as to reflect specific frequencies of the sunlight.

Preferably, the yarn from which the net is made has external layers preferably made of the same homogenous materials, particularly those having the lowest melting point. The yarns may have a thickness between 1-10 mm.

Preferably, the yarn is made from a multi-layer film which has a thickness between 18-240 μm. The yarn is woven into a preliminary net for subsequent treatment The preliminary net may have a width of up to 7 m.

Further, the invention is also related to a process of producing a net.

According to the invention, the process is characterized in that a plurality of fibers are supplied to a knitting machine, particularly a Raschel knitting machine, that the knitting machine generates a preliminary net from the fibers and that the preliminary net undergoes a thermal procedure and that the thermally treated sheet is supplied to a wrapping and packaging section.

Advantageously, the process is characterized in that a multi-extrusion head produces a multi-layer film or a sheet.

Preferably, the fibers are prestretched before being supplied to the knitting machine.

In an advantageous method of producing a net, the preliminary net is subjected to thermal treatment after knitting. Thereby, the external layers of the preliminary net are liquefied.

Further, the yarns are compressed or formed during the thermal treatment. Preferably, the yarns are homogenized at least at the joints of the knitted sheet.

BRIEF DESCRIPTION OF THE DRAWINGS

Hereinafter, the preferred embodiment of the invention is described in more detail by means of the drawings wherein.

DETAILED DESCRIPTION OF THE PREFERRED EMBODIMENTS

Figure 6A:
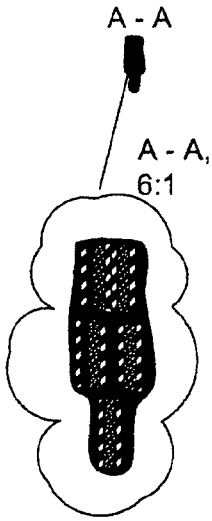
FIG. 6*a* shows a part of the cross-section of FIG. 6 according a section-line A-A, and FIG. 7*a*, b shows agricultural products packaged by a net according to the invention.
Figure 6:
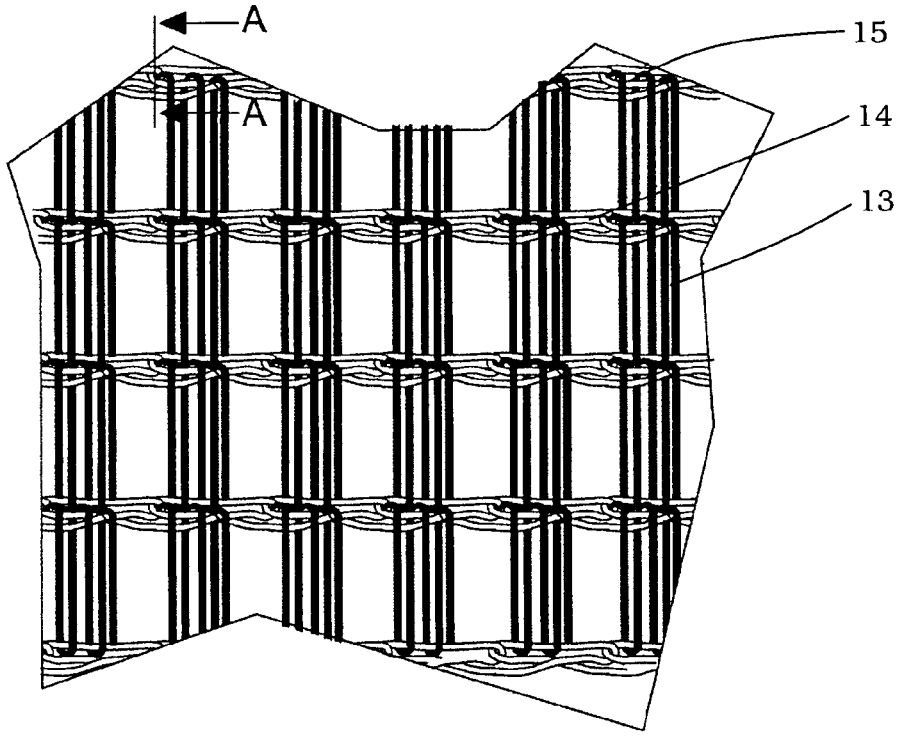
FIG. 6 shows a top view of a layer.

Hereinafter the following definitions will apply:

1. extrusion: forcing out—a method used for producing synthetic film;
2. co-extrusion: a method used for producing multiple layers of synthetic film;
3. multi-layer: a thin plastic film made of multiple layers of the same or different materials;
4. yarns: fine strips detached from the initial plastic multi-layer film of controlled width;
5. knitting: a method used for producing nets from wefts and warps (see FIG. 6);
6. loops: forms in a net that are made by knitting wefts and warps (see FIG. 6).

Figure 1:
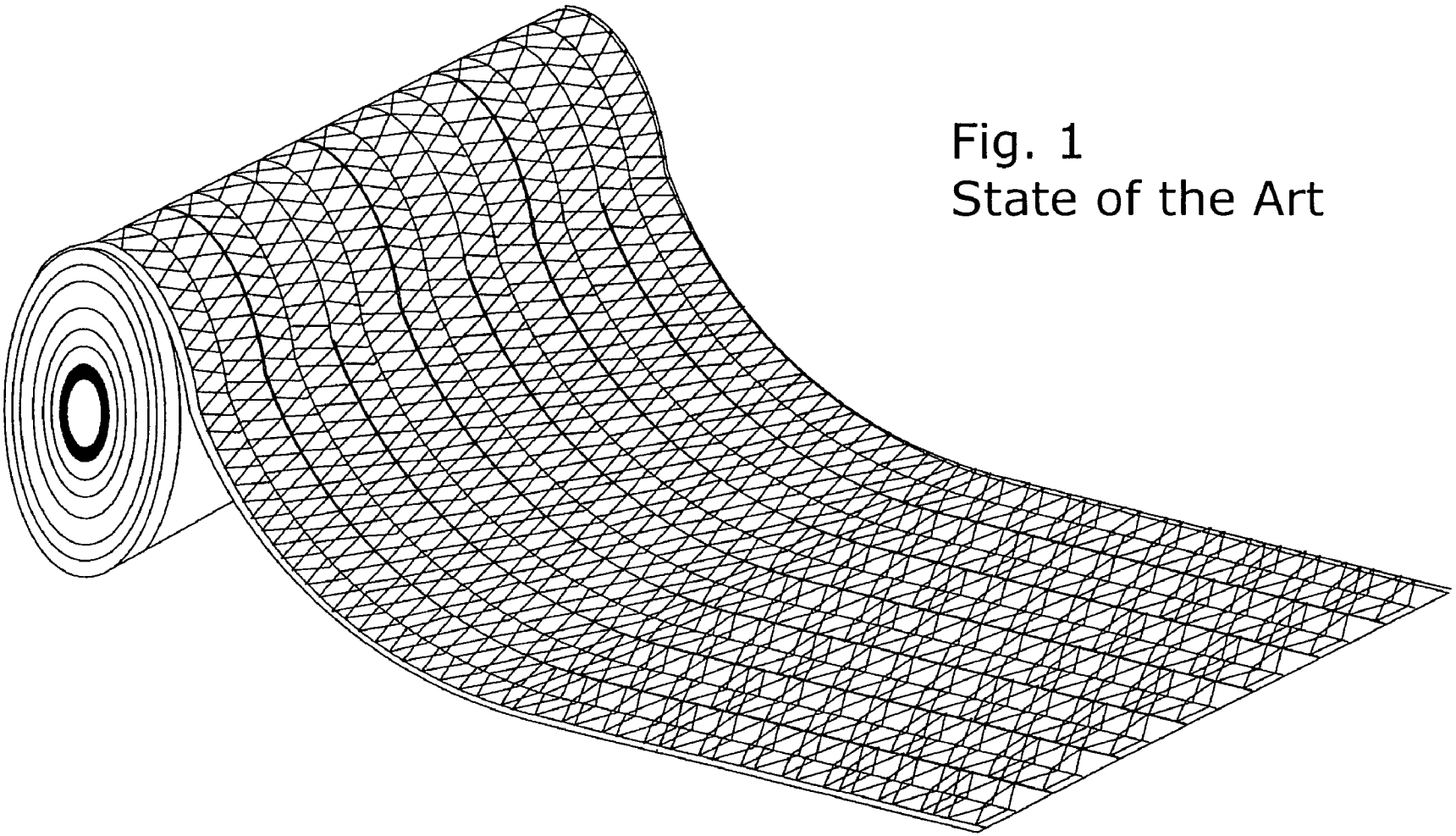
FIGS. 1, 2 show a net according to the prior art.
Figure 2:
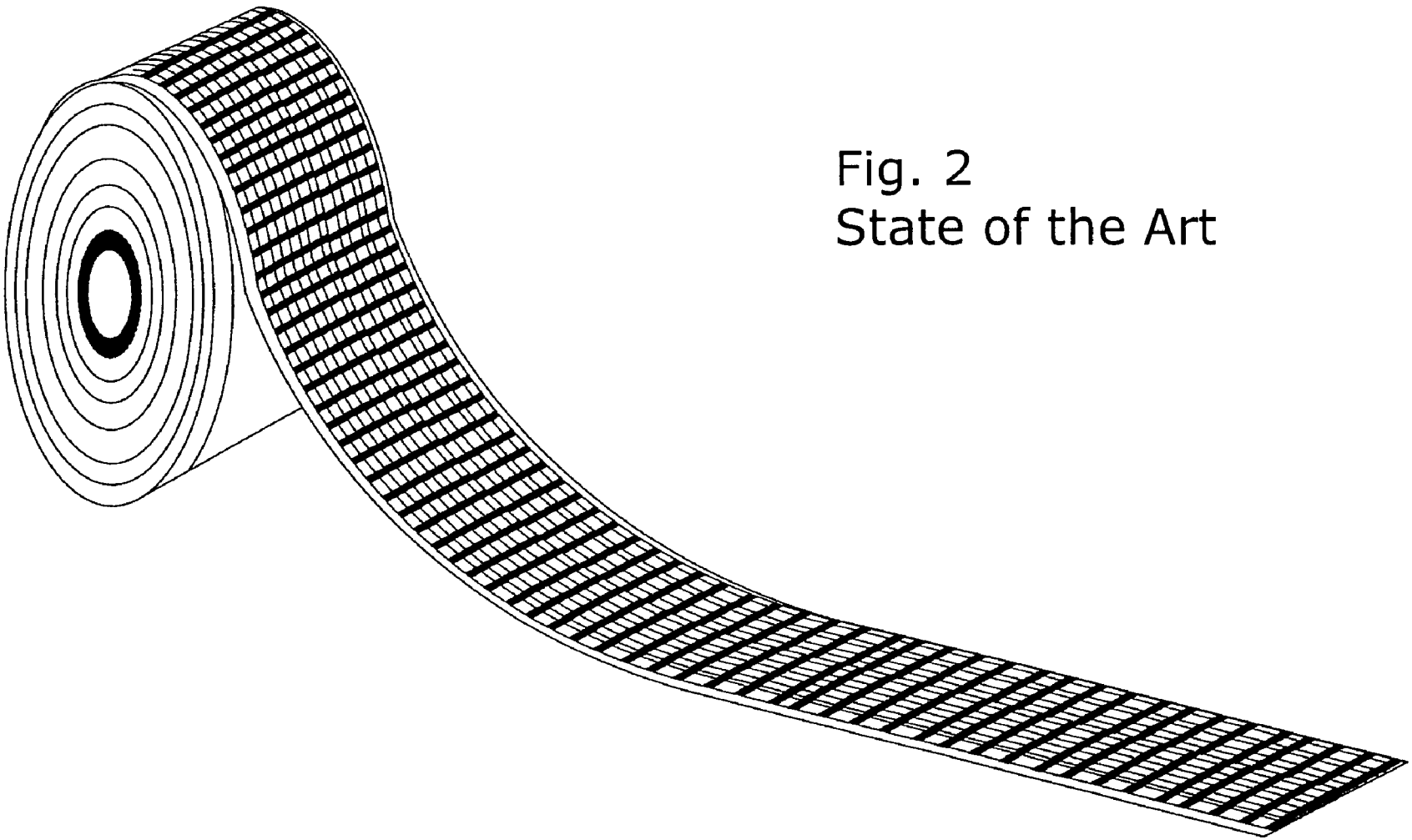
Figure 3:
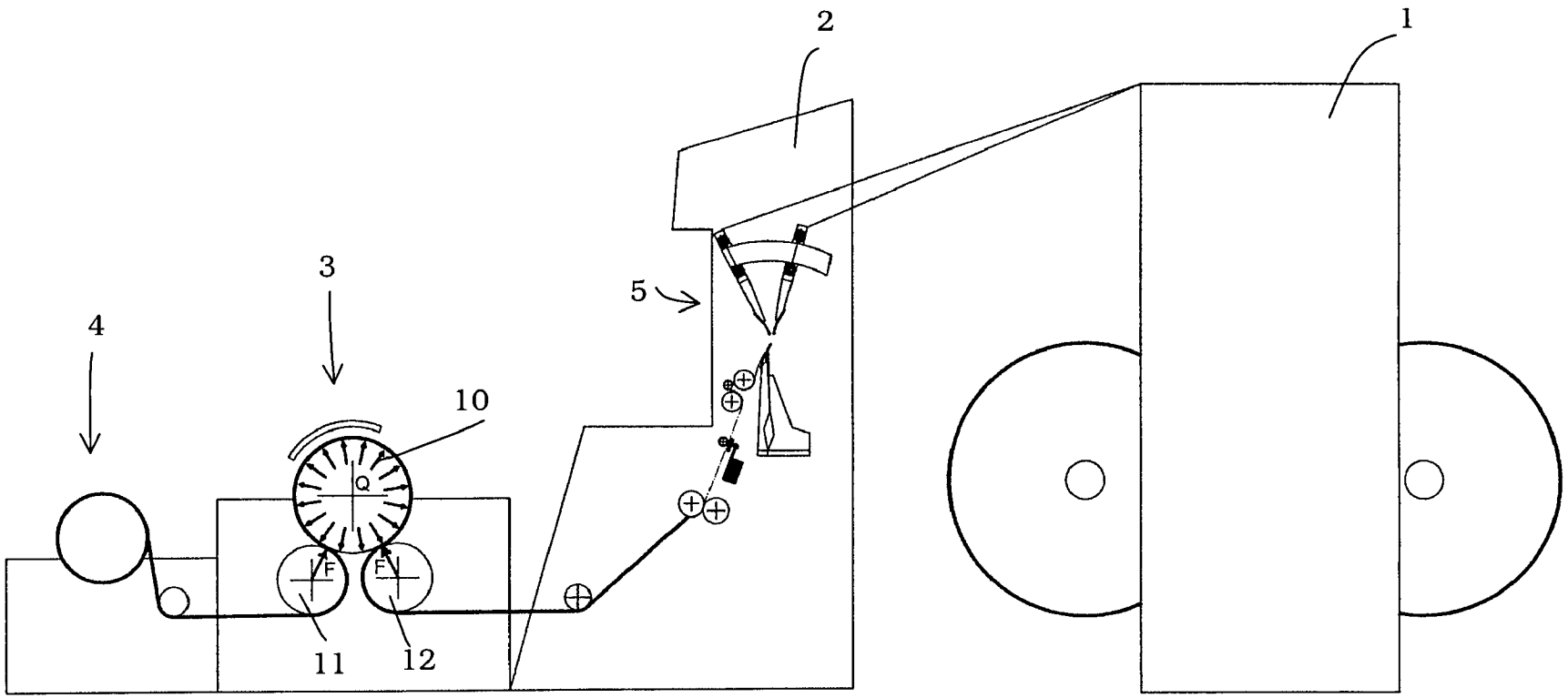
FIG. 3 shows a fiber production and pre-stressing machine, a Raschel knitting machine, a heating and compressing arrangement and a wrapping and packaging section.

FIG. 3 depicts the production line used for manufacturing multi-layer products comprising a fiber production and pre-stressing section 1, a knitting machine 2, a thermal procedure section 3 and a wrapping and packaging section 4. The knitting machine 2 is described in more detail in PCT/EP2006/001619 which is incorporated herein by reference.

Figure 4:
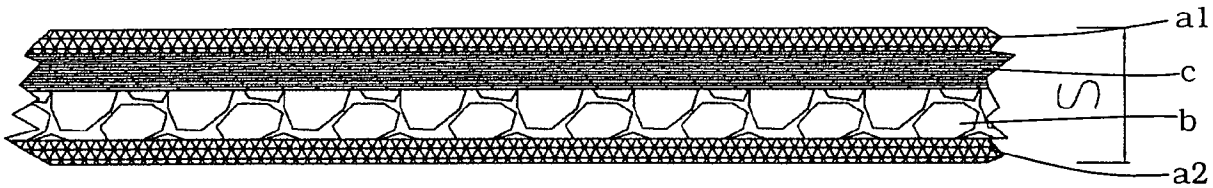
FIG. 4 shows a cross-section of a first multilayer film.
Figure 5A:
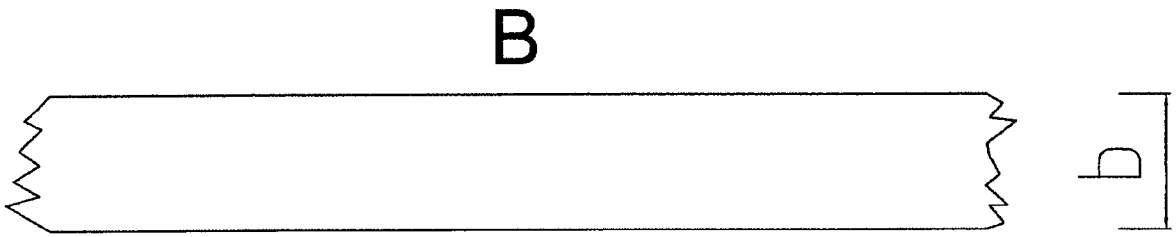
FIG. 5*a* shows a top view of the layer of FIG. 5.
Figure 5:
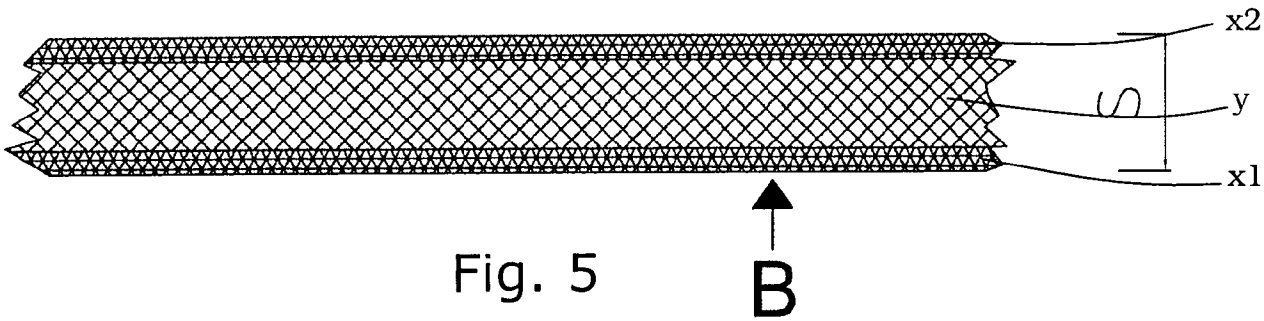
FIG. 5 shows a cross section of a second multilayer film.

Initially, a multi-extrusion head produces a multi-layer film. The film comprises a number of overlapping layers of different materials (cf. FIGS. 4 to 6). If the controlled combination of materials does not allow a high prestretching of the fibers, these are forwarded to a knitting machine 2 that may be a Raschel knitting machine. Depending on the desired knitting pattern, they are knitted initially into preliminary nets, e.g. as depicted in FIGS. 4 and 5.

After knitting, the preliminary net undergoes a thermal treatment. After thermal treatment and compressing, a net is created. Thereafter, the net is subjected to ironing. The preliminary net is transported over the cylindrical surface of a heating cylinder 10 whose temperature is sufficient to melt the layer of the preliminary net transferred by its surface whereas two counteracting cylinders or rollers 11, 12 press against the cylinder 10 so as to exert a compression of the preliminary net. Cylinder 10 may be constructed as a drying cylinder of the drying section of a paper machine. Additionally or in the alternative the net is heated by radiation heat by means of a shield 17 positioned in a distance from cylinder 10. During this current stage, the knitted nets are heated to the required level of temperature so that the external layers of the fibers are liquefied, i.e. the materials of layers a1 and a2 of FIG. 4 and materials of layers x1 and x2 of FIG. 5, and the pressure applied by the rollers 11, 12 ensures that the liquefied homogenous external layers of the yarns are unified (homogenized) (i.e. FIG. 6, section A-A).

The innovation of the processing in question is that, whereas the preliminary net comprises knitted multi-layer yarns which are independent, the liquefaction and compression of the selected homogenous layers ensures the gluing together wefts 13 and warps 14 at the joints 15 of the knitting loops and thus it creates a compact flexible net (i.e. FIG. 6). The said processing ensures that, depending on the intended use of a product, it can be manufactured with specific additional properties.

The said materials are preferably thermoplastic, and may consist of a combination of polyolefines, e.g. high-density or low-density polyethylenes as PE, EVA, PVC, PA. In FIG. 4 a combination of different materials in layers a1, b, c, a2 is shown, wherein the outer layers a1 and a2 are composed of at least substantially the same materials, as well as mixtures of polyolefines with such materials as polycarbonic materials, or iridescent materials, coloured masterbatch (i.e. FIG. 5—is a combination of different materials in layers x1, y, x2, wherein the outer layers x1 and x2 are composed of at least substantially the same materials). With the said combination of materials, a homogenous composition of the external layers of the material is achieved.

The said film, depending on its intended use, may have a width between 300 mm and 1200 mm, i. e. in the cross-direction with regard to the production direction of the knitting machine, and its thickness may range from 18 μm to 240 μm. Then the film is cut into thin strips by the fiber production machine. Depending on the composition and layers of the materials they comprise, the fibers are subjected to controlled stretching so as to achieve their desired final elasticity.

A net produced by the above processing method may serve for packaging different products like vegetables and fruits. Agricultural products, such as onions, potatoes, etc. (i.e. FIG. 7*a, b*) may be packaged by a net according to the invention. The said net has a high strength so that a considerable weight of a packaged product may be transported, the net provides for an elegant appearance in order to increase the marketability of the product.

For the above reasons, the net comprises thin and lightweight multi-layer fibers, e.g. an ideal composition of such materials is as follows: At least one of the first outer layers is made of LLDPE (linear low density polyethylene) and its thickness is equal to 20% of the total thickness of the end product (i.e. FIG. 4, layers a1 and a2). The at least one inner layer is made of HDPE (high density polyethylene) and its thickness is equal to 60% of the total thickness of the end product (i.e. FIG. 4, layer b). The third layer, i. e. the second outer layer having a thickness equal to the remaining 20% of the total thickness of the end product, is made of color or non-color LLDPE (i.e. FIG. 4, layer a2).

Figures 7A, 7B:
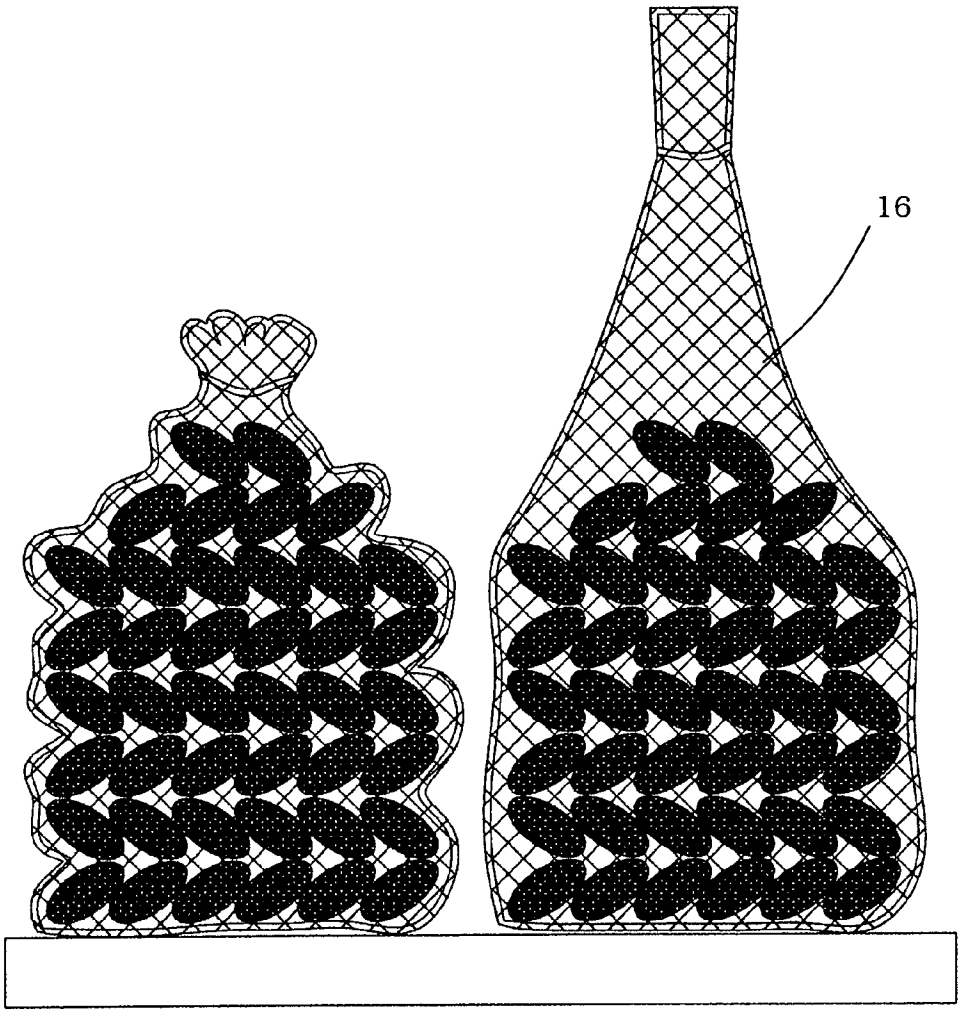

Thus the final product manufactured after the completion of the production process will be a lightweight, flexible and strong, color or non-color net, which due its homogeneity and stability, will make the packaged products more conspicuous in the area where such products are sold. This is shown by a net 16 (FIG. 7*b*).

By the aforementioned technology described above, a line of new pallet packaging nets can also easily be manufactured. These products will have all the advantages required for such materials, e.g. in the case where the end user wishes to have a pallet packaging product, having high strength and low elasticity, preferably over 80% (FIG. 7*b*). The produced net, when cut, will not spread threads around, for the aforementioned reasons. In order to manufacture such a product, multi-layer synthetic yarns will be used, which will have been subjected to low prestretching and will be composed as follows: 20% LLDPE, 60% HDPE, 20% LLDPE (FIG. 4). Thus the knitted product manufactured based on the above described processing method, will acquire the following advantages: The fact that the low melting temperature of the external layers of LLDPE ensures the satisfactory homogenization of fibers, thus preventing the production of fine threads at cutting; HDPE ensures the high strength and low elasticity of the material. The multi-layer composition of the product increases its tensile strength, thanks to the surface stresses created by the multiple layers of the material.

Similarly, a new line of products can be manufactured if iridescent or polycarbonic materials are added (FIG. 3) in the extruder or in the knitting machine thus rendering the net iridescent so as to reflect specific frequencies of the sunlight. It is equally easy to manufacture nets used for shading plants, which act as solar spectrum filters preventing infrared radiation from penetrating, and thus speeding up the development of such plants.

The essence of this present invention is that, after the production of layers of synthetic films derived from co-extrusion, all the said materials will be able to acquire enhanced features compared to their initial properties.

In conclusion, the film produced, and thus the resulting synthetic yarns, are distinguished for their multi-layer structure and due to the thermal procedure and compression they have undergone, the materials of the external layers are homogenized, mainly at the joints of knitted net fibers, which are critical (FIG. 6, section A-A). The above facts do have a positive effect on the final use of the nets.

The invention claimed is:

1. A net made from a net material of at least two layers of multi-layered thermoplastic synthetic knitted yarns, said knitted yarns having wefts and warps which meet at joints, said knitted yarns being homogenized by application of a thermal process to initially melt the yarns at the joints for creating a compact, flexible net;

the multi-layered yarns comprising at least three layers including an inner layer comprising high-density polyethylene and two external layers comprising low-density polyethylene.

2. A net according to claim 1 wherein said yarns are homogenized by compression.

3. A net according to claim 1 wherein said yarns are pre-stretched.

4. A net according to claim 1 wherein said multi-layered yarns are derived from strips cut from a multi-layer film made in a process.

5. A net according to claim 4 wherein said multi-layered strips comprise the at least three layers.

6. A net according to claim 4 wherein at least one of the layers of said multi-layered yarns comprises at least a single synthetic yarn made from at least one polyolefine.

7. A net according to claim 6 wherein the at least one of the layers of said multi-layered yarns comprises at least a single iridescent or polycarbonic material rendering the net iridescent.

8. A net according to claim 7 wherein the iridescent or polycarbonic material reflects specific frequencies of the sunlight.

9. A net according to claim 1 wherein the external layers are made of the same homogenous materials.

10. A net according to claim 1 wherein the net comprises yarns having a thickness between 1-10 mm.

11. A net according to claim 4 wherein the multi-layered film has a thickness between 18-240 μm.

12. A net according to claim 4 wherein the multi-layered film has a width of up to 7 m.

13. A net according to claim 6, wherein said polyolefine or the combination of polyolefines comprises a particularly high-density or low-density polyethylene.

14. A net according to claim 13, wherein said high-density or low-density polyethylene is selected from the group consisting of PE, EVA, PVC, PA and a mixture of polyolefines.

15. A net according to claim 9 wherein the same homogenous materials have the lowest melting point.

16. A method for producing a net, said method comprising:

producing a multi-layer film, the film including thermoplastic material, with a multi-extrusion head, the multi-layered film comprising at least three layers including an inner layer comprising high-density polyethylene and two external layers comprising low-density polyethylene;

cutting the multi-layer film into thin strips to produce multi-layer fibers or multi-layer yarns;

knitting the yarns into a preliminary net with a knitting machine, the preliminary net having the external layers of yarns;

thermally treating the preliminary net to temporarily liquefy the external layers of yarns; and compressing the thermally treated preliminary net to homogenize or unify the yarns to produce a net.

17. A method according to claim 16 and further comprising:

pre-stressing the multi-layer fibers or multi-layer yarns in a step following the cutting step.

18. A method according to claim 16 wherein the knitting machine knits the preliminary net, the preliminary net having wefts, warps and joints, the thermally treating and compressing of the preliminary net liquefies and compresses the joints to create a compact, flexible net.

19. A method according to claim 16 wherein the step of thermally treating the preliminary net comprises transporting the preliminary net over a heated cylinder.

20. A method according to claim 19 wherein the step of compressing the preliminary net comprises pressing at least one cylindrical roll against the preliminary net and the heated cylinder as the preliminary net is transported over the heated cylinder.

21. A method according to claim 16 wherein the step of thermally treating the preliminary net comprises heating the preliminary net by radiation heating as the preliminary net is transported over the cylinder.

22. A method according to claim 16 and further comprising the step of ironing the net after the net has been thermally treated and compressed.

23. A method according to claim 16 and further including the step of wrapping and packaging the net.

* * * * *